US005349781A

United States Patent [19]

Libardi

[11] Patent Number: 5,349,781

[45] Date of Patent: Sep. 27, 1994

[54] SIMULATION-PREVENTING TURNSTILE

[75] Inventor: Mario Libardi, Levico Terme, Italy

[73] Assignee: Italdis S.p.A., Lavis, Italy

[21] Appl. No.: 36,641

[22] Filed: Mar. 24, 1993

[30] Foreign Application Priority Data

Mar. 25, 1992 [IT] Italy ..... MI92 A 000709

[51] Int. Cl.[5] ..... E06B 11/08

[52] U.S. Cl. ..... 49/47; 49/25

[58] Field of Search ..... 49/47, 46, 25

[56] References Cited

U.S. PATENT DOCUMENTS

| | | | |
|---|---|---|---|
| 2,341,546 | 2/1944 | Hagenbook | 49/25 X |
| 3,609,914 | 9/1969 | Berl | 49/25 X |
| 3,753,317 | 8/1973 | Turpin et al. | 49/25 X |
| 3,913,717 | 10/1975 | Collins | 49/46 X |

FOREIGN PATENT DOCUMENTS

| | | | |
|---|---|---|---|
| 1638294 | 3/1991 | U.S.S.R. | 49/46 |

*Primary Examiner*—Philip C. Kannan

*Attorney, Agent, or Firm*—Panitch Schwarze Jacobs & Nadel

[57] ABSTRACT

A turnstile provided with an electronic control unit having a photoelectric cell (8, 9) connected therewith, located downstream from the turnstile revolving member (3), in the user walking-through direction, in order to check if the user has actually walked through. Therefore, the turnstile has the ability to detect and issue a signal for, a simulated walking-through attempt performed by a user who actuates turnstile revolving member (3) without actually walking-through said turnstile, and it proves particularly effective for checking the arrival and the presence of personnel at the working posts.

3 Claims, 2 Drawing Sheets

SIMULATION-PREVENTING TURNSTILE

Figure 1:
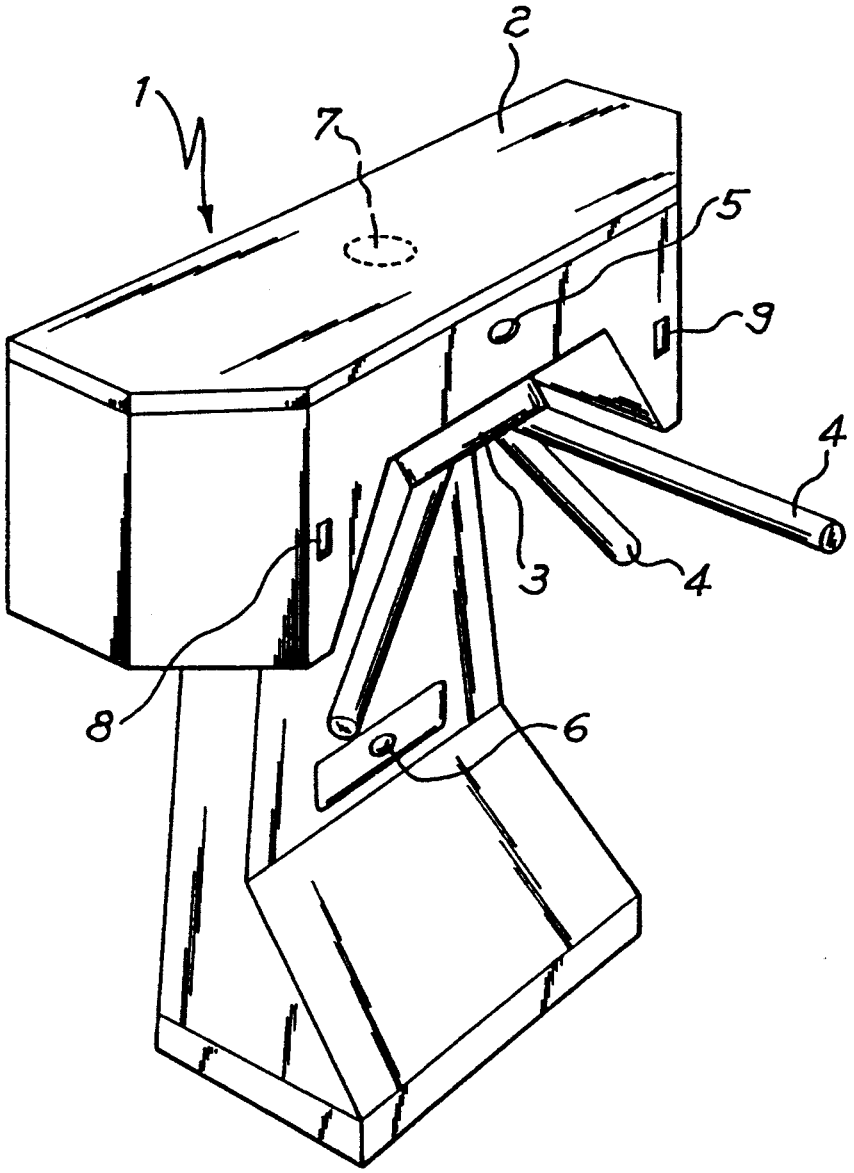

This invention concerns turnstiles used to detect the entrance and/or the exit to/from controlled areas, in particular it concerns a simulation-preventing turnstile adapted to check that people actually walk through the monitored passage.

Various turnstile types are already known, suitable for monitoring access to shops, subway stations, and other facilities of many kinds and, recently, also the access to working areas. Said turnstiles allow people to walk through only after the user has obtained clearance from dedicated members, by means of a magnetically, optically or similarly readable personal badge. Once said clearance has been given, an electronic control unit provides temporary unlocking of the turnstile revolving member, which normally prevents passage in front of the turnstile. Very often, the same control unit is connected with sensors of various types, suitable for detecting turnstile unauthorized sidestepping or walking-through attempts, in order to trigger suitable optical and/or acoustical alarm signals. Furthermore, in certain cases, the control unit is given also the task of checking that the user, once he has obtained clearance for walking-through, actually gets to actuate the turnstile revolving member within an adequate predetermined maximum time lag. In fact, in some cases the turnstile monitoring function, rather than preventing unauthorized people from walking-through, is meant to checking and recording that the user has actually walked-through. Reference is made herein, for instance, to the automatic monitoring of working periods, therefore of the time during which the personnel has actually attended work, which is absolutely necessary in the case of large plants or factories and in any case when a large number of workers have to access the same working post. In this type of application the known turnstiles prove unsatisfactory in that it is very simple to simulate the walking-through and therefore to deceive the personnel attendance monitoring system. In fact, after having obtained clearance for walking-through, from the reader of personal badges or equivalent device, it is enough to actuate the turnstile revolving member for instance by hand, without actually walking through it, thereby completing the required walking-through procedure and obtaining a recording of having reached the working post. Therefore, it is an object of this invention to provide a device which, in addition to performing all the functions pertaining to the previously known turnstiles, has a further ability to detect and report simulated walking-through attempts performed by the user. The above object is met by means of a turnstile provided with an electronic control unit connected to a timer and to optical and/or acoustical alarm means, and further including a sensor located downstream from the turnstile revolving member, adapted to detect if the user actually walks through, and to send a signal thereof to the control unit, whereby the latter, in case of negative occurrence, triggers a special alarm signal. The simulation-preventing turnstile according to this invention has the advantage that, compared with the state of the art, it provides a more flexible sequence of events required for the control unit to recognize a walking-through procedure as being correct, whereby it becomes virtually impossible to fulfill the required procedure by simulated operations.

Figure 2:
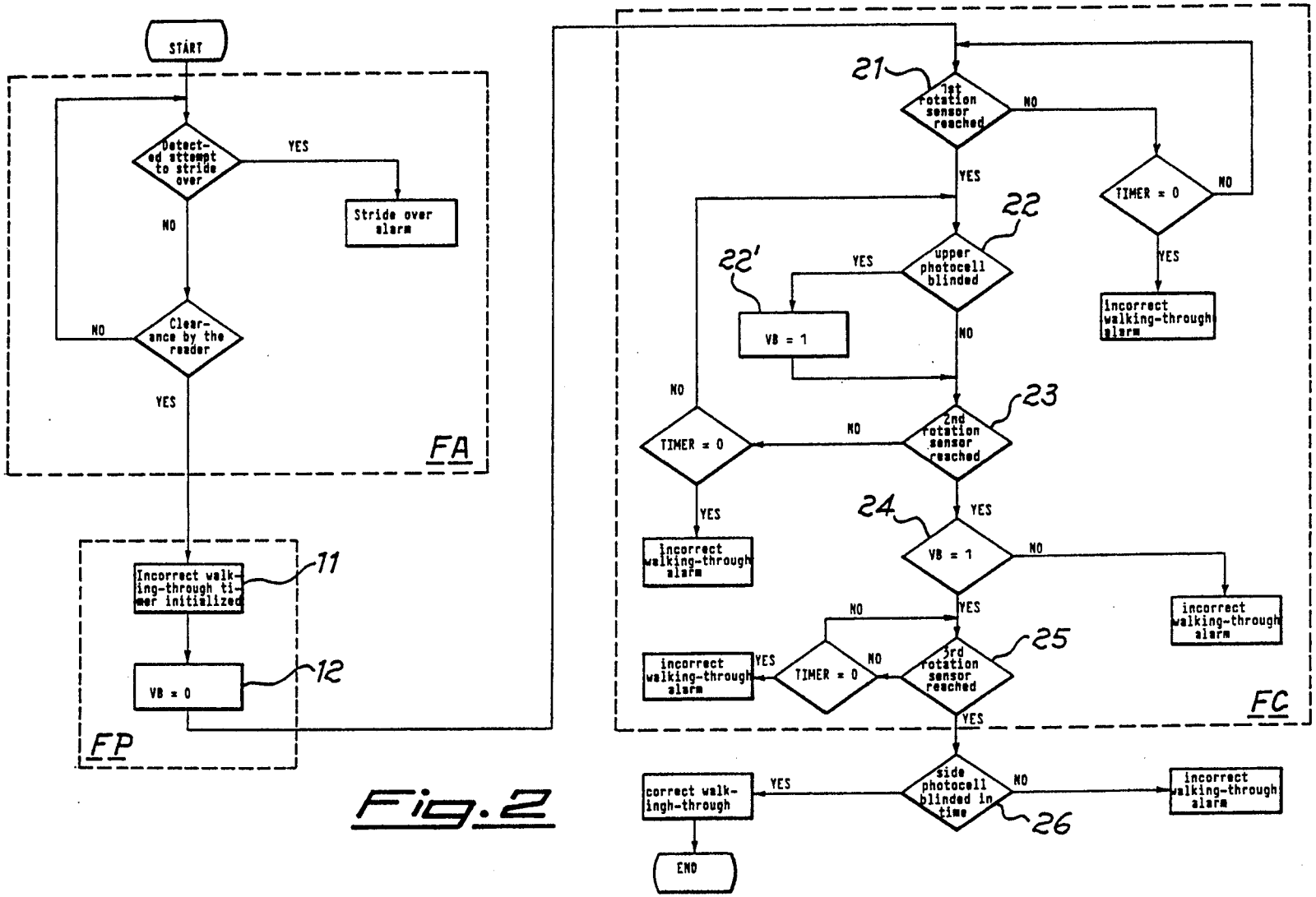

The above and other advantages of the simulation-preventing turnstile according to this invention will become more apparent from the following detailed description of a preferred embodiment thereof, referring to the attached drawings, wherein:

FIG. 1 is a perspective view of a simulation-preventing turnstile according to this invention; and FIG. 2 is a flow diagram showing the operation of the turnstile of FIG. 1.

Referring now to FIG. 1, as it is shown therein, the simulation-preventing turnstile according to this invention, shown in general at 1, comprises a housing 2 from which there projects at an angle the turnstile revolving member, which in this case is the tripod type. Therefore it includes three arms 4 integral with head member 3 and diverging therefrom at respective points located 120 degrees apart just in such a way as to form the so-called tripod. Before and after each 120 degree rotation of head member 3 caused by a user walking through, one of the three diverging arms 4 gets to be located in a horizontal position, wherein it blocks the passage in front of turnstile 1, while the other pair of diverging arms 4 are in a substantially sloping position. However the turnstile may be of the cross-shaped revolving member type wherein the revolving member rotation axis is horizontal, rather than substantially vertical, as in the tripod type turnstile. An electronic control unit, preferably a micro-processor, located within housing 2 and therefore not shown, is connected with all the sensor means the turnstile is provided with. As it will be explained in detail in the following, said unit continuously monitors the turnstile condition, and the development of the sequence of events corresponding to the user walking-through, and in addition it verifies that said sequence gets completed within a predetermined maximum time lag. Any exception to that sequence of events will then result in an alarm signal and possibily the user having caused it will be identified. When unlocked by the control unit, the above head member 3, may revolve, together with arms 4, in the direction it is enabled to, and the angular position thereof is constantly known to the electronic control unit by means of three sensors, perferably Hall effect type sensors, not shown in the drawing in that they are received within housing 2. Similarly, there is not shown the pair of personal badge readers, or equivalent devices, which for sake of simplicity are called readers in the following. They are provided at the turnstile ends, and they are necessary for the temporary unlocking of head member 3 and arms 4, thereby enabling them to revolve in one direction. In addition, turnstile 1 includes a pair of photoelectric cells 5 and 6 located above and below that arm 4 which is in a horizontal position, respectively, adapted to detect anauthorized walking-through attempts, above or under said arm 4, said attempts being generally called "stride over attempts". The stride-over preventing barrier is in general completed by a pressure sensor 7, shown in dashed lines in the drawing, located within housing 2, and sensitive to a weight bearing on the upper surface of said housing, in order to give a signal when a person attempts to stride over turnstile 1 by walking, or in any case leaning on said surface. The simulation-preventing turnstile according to this invention includes eventually a pair of photoelectric cells 8 and 9 located on the sides of housing 2, ahead and after revolving head member 3. Blinding of that photoelectric cell 8 or 9 which is located downstream from head member 3, in the passing direction of the user is the final event of the sequence of events required by the control unit to record the walking-through as a correct one, and it certifies that the user has actually walked through the turnstile passage after having pushed the horizontal arm 4 and having rotated head member 3 by 120 degrees. In the following, the photoelectric cell located downstream, in the user passing direction will be called downstream photoelectric cell, for sake of simplicity. In FIG. 2 there is shown the algorithm used in said microprocessor-based electronic control unit, controlling the simulation-preventing turnstile operation according to this invention. Normally, said turnstile is in a waiting condition, shown within dashed line box FA, wherein passage is closed in that no clearance has been given by the reader to a temporary unlocking of the head member and thereby to the arm actually blocking said passage. Instead, in said condition, photoelectric cells 5 and 6 are actuated, as well as pressure sensor 7, in order to watch over possible attempts to stride over the barrier.

When the user has made himself recognized by his personal badge, a clearance signal provided by one of the readers gets the turnstile out of waiting condition FA and the monitoring over the sequence of events or conditions corresponding to the user walking-through is started. First of all, the preliminary step is completed, as shown by the dashed line block FP, wherein a "timer" 11 is initialized. The timer checks that the user causes a regular 120 degree rotation of the turn-stile head member, within a reasonable and predetermined time lag. In addition, preliminary step FP provides for a binary variable, or "flag" VB, to be set, at 12, to one of the two values thereof, for instance zero, for the reasons to be explained in the following. During next step, or monitoring step, shown by dashed line box FC, provision is made so that, while said head member rotates, a reference point thereof reaches in sequence the three Hall effect sensors mentioned above, the latter of which corresponds to having completed the 120 degree rotation of said head member. Boxes 21, 23 and 25 of FIG. 2 show the three tests on turnstile head member rotation, performed in sequence by the control unit by means of said three Hall effect sensors. In case the time lag by which said timer had been initialized in preliminary step FP expires, an "incorrect walking-through" alarm signal will be issued at the first among checks 21, 23, 25 having produced a negative result. In addition, in order that the user walking-through procedure be recognized as correct, it is necessary that during the period of time included between the moments in which the first two head member rotation sensors are reached, upper photoelectric cell 5 is blinded out by the user. In fact, a positive result of check 22 on this event results in a change 22' of the value of the binary variable or "flag" VB mentioned above, and a subsequent check 24 whether said change has taken place, performed after said rotation sensor has been reached, and resulting in a negative occurrence, would cause an alarm signal to be issued due to "incorrect walking-through" caused by a user abnormal behavior and, possibly, by an attempt of simulated walking-through. On the contrary, when step FC comes to a positive conclusion after the time lag predetermined in step FP, after having performed checks 21, 22, 23, 24 and 25, as mentioned above, the simulation-preventing turnstile according to this invention provides for performing a last check, which is conclusive in order to determine if a user has managed to dodge the previous checks. In fact, starting when step FC has positively ended with a completion of a turnstile head member rotation, the control unit using the timer mentioned above starts a test 26 concerning the time spanning from completion of the head member rotation to the blinding out of the photoelectric cell downstream from said head member. If said photoelectric cell does not get blinded out within a predetermined time lag, that shows that the user has not walked beyond the revolving head member, but he has only simulated the walking-through, whereby a "incorrect walking through" alarm signal will be triggered. If, on the contrary, said last check 26 has a positive result, a regular user walking-through is ensured, the walking-through procedure is recognized as being correct, and the turnstile goes back to its waiting step FA. The procedure described above may be modified, for instance by providing a single check over the time lag, including last test 26 as well, on blinding out of the side photoelectric cell, and/or by providing a further check on the one, out photoelectric cells 8 and 9, which is located upstream relative to the user passing direction, said check being meant to delect whether a user who has possibly simulated a walking-through, is moving away from said turnstile. The microprocessor-based control unit mentioned above may be of any type fitting the purpose, the same being true for pressure sensor 7, and photoelectric cells 5, 6, 8 and 9 connected with said control unit, even though the latter will preferably be the modulated infrared radiation type. The timer mentioned above may be implemented by the oscillator provided within said control unit. The two readers of personal magnetic badges, or equivalent devices may be of any known type fitting the purpose, the same thing being true for the optical and/or acoustical devices provided for issuing alarm signals. In addition, the turnstile might be provided with light emitting condition indicators (for permitted walking-through direction, off-service, and so on) for user convenience. It should eventually be understood that the function of detecting simulated walking-through attempts described above, may be implemented on any type of turnstile already known. The above and other additions and/or modifications may be made by those skilled in this art to the simulation-preventing turnstile according to this invention while remaining within the scope of said invention.

I claim:

1. A simulation-preventing turnstile having an upstream and a downstream side and comprising:

a housing;

a revolving member extending from the housing between the upstream and downstream sides;

a first optical sensor located at the upstream side of the housing;

a second optical sensor located at the downstream side of the housing;

a third optical sensor located above the revolving member; and a fourth optical sensor located below the revolving member, each of the first through fourth optical sensors providing a triggering signal to an electronic control unit, the optical sensors being triggered in a predetermined manner when a person correctly passes through the turnstile from the upstream side to the downstream side, the electronic control unit activating an alarm when a deviation from the predetermined manner is detected.

2. The turnstile of claim 1 wherein the first through fourth optical sensors comprise at least one modulated infrared radiation photoelectric cell.

3. The turnstile of claim 1 further comprising a pressure sensor positioned on a top portion of the housing, the pressure sensor being sensitive to a person asserting pressure on the top of the housing when attempting to pass over the revolving member, the pressure sensor providing a triggering signal to the electronic control unit, the predetermined manner taking the triggering signal from the pressure sensor into consideration.

* * * * *